US006623290B2

(12) United States Patent
Tran

(10) Patent No.: US 6,623,290 B2
(45) Date of Patent: Sep. 23, 2003

(54) COVERLESS ZIF SOCKET FOR MOUNTING AN INTEGRATED CIRCUIT PACKAGE ON A CIRCUIT BOARD

(75) Inventor: Donald T. Tran, Phoenix, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/017,588

(22) Filed: Dec. 18, 2001

(65) Prior Publication Data

US 2003/0114035 A1 Jun. 19, 2003

(51) Int. Cl.[7] ..... H01R 4/50
(52) U.S. Cl. ..... 439/342
(58) Field of Search ..... 439/342, 259, 439/261–265, 266, 268, 269.1, 269.2, 270, 71, 65, 310

(56) References Cited

U.S. PATENT DOCUMENTS 5,203,021 A * 4/1993 Repplinger et al. ..... 439/266
5,482,471 A * 1/1996 Mori et al. ..... 439/263
5,493,150 A * 2/1996 Matsuoka et al. ..... 439/259
5,547,389 A * 8/1996 Hsu ..... 439/342
5,622,514 A * 4/1997 Crompton, et al. ..... 439/342
5,658,160 A * 8/1997 Lai ..... 439/342
5,707,247 A 1/1998 Konstad
6,146,173 A 11/2000 Yagi
6,164,999 A 12/2000 McCutchan et al.
6,219,241 B1 4/2001 Jones
6,276,949 B1 8/2001 Nakano et al.
6,347,039 B1 * 2/2002 Lee ..... 361/760
6,361,345 B1 * 3/2002 Tan ..... 439/342
6,379,172 B1 * 4/2002 Howell et al. ..... 439/342

OTHER PUBLICATIONS

Intel Mobile Processor Micro–FCPGA Socket (mPGA479M) Design Guidelines, Revision 1.0, Order No. 298520–001, Nov. 2001

* cited by examiner

*Primary Examiner*—Renee Luebke
*Assistant Examiner*—Felix O. Figueroa
(74) *Attorney, Agent, or Firm*—Kenyon & Kenyon

(57) ABSTRACT

A zero insertion force socket for an integrated circuit package. In an embodiment, the socket has an uncovered base, a plurality of conductive contacts coupled to the base, and a slidable bar coupled to the base.

49 Claims, 6 Drawing Sheets

COVERLESS ZIF SOCKET FOR MOUNTING AN INTEGRATED CIRCUIT PACKAGE ON A CIRCUIT BOARD

FIELD OF THE INVENTION

Embodiments of the present invention relate to a socket for mounting an integrated circuit package on a circuit board. In particular, the present invention relates to a system and method for inserting an integrated circuit package on a circuit board without applying a damaging force to the pins.

BACKGROUND

Circuit boards often contain integrated circuit (IC) packages, such as central processing units or other integrated circuit devices, that are mounted on the board. The integrated circuit package generally has a substrate upon which a silicon chip is supported and a series of metal pins that extend from the underside of the integrated circuit package. The pins, which may be arranged in one or more rows, are used to conduct electric current between the chip and the circuit board. The integrated circuit package is not typically mounted directly to the board, but rather is directly mounted on a socket which is itself connected to the board. The socket may contain a base that is attached to the board as well as contacts which create electrical connections with the pins of the integrated circuit package. Each contact may contain an opening that is spaced to allow a pin to fit tightly within. When an integrated circuit package is being connected to the board, a relatively significant force is generally applied to the pins so that they tightly engage the contacts as is desired for a reliable electrical connection.

The pins of an integrated circuit package are often delicate and easily bent. If the pins are damaged, the integrated circuit package may not sit correctly and may malfunction. Damage to the pins may render an expensive integrated circuit chip unusable. A circuit board manufacturer may employ quality controls to ensure that the pins are not damaged when an integrated circuit package is inserted into a socket. However, an end-user may often desire to remove an old integrated circuit package from a circuit board and insert a new integrated circuit package. For example, a user may wish to insert a new central processing unit (i.e., an upgrade) onto the motherboard of an existing personal computer. Because end-users may not have the tools and/or skills to insert and remove an integrated circuit package without damaging pins, sockets have been developed to enable an integrated circuit package to be easily removed or inserted while still ensuring that the device securely fits into the socket. These sockets, which are often referred to as "zero insertion force" (ZIF) sockets, employ a mechanism to control the application of the force used to engage the pins with the contacts.

In addition to a base and electrically-conductive contacts, conventional ZIF sockets typically also have a sliding cover on top of the base, a bar which is coupled to the cover, and a lever arm (or actuator arm) that is coupled to the sliding bar. In such ZIF sockets the integrated circuit package is mounted on top of the socket cover, with the pins of the integrated circuit package protruding through the holes in the cover. The cover guides the pins when the chip is being placed on the socket. In addition, the cover is used to apply horizontal force directly to the pins in order to actuate the pins onto the electrical contacts in the socket base. Before inserting an integrated circuit package into such a ZIF socket, the lever arm is raised, thus sliding the sliding arm and cover into an "open" position. The pins of the integrated circuit package may then be inserted into the holes in the cover. At this point, the pins would generally not be engaged with the contacts. To engage the pins, the actuator arm is closed, causing the sliding bar and cover to slide horizontally across the base of the socket (i.e., in the same general direction as the plane of the circuit board). When the cover slides, it directly pushes against the pins so that the pins are engaged with the contacts. To remove the integrated circuit package, the lever arm is opened so that the pins may be disengaged from the contacts and the integrated circuit package may be removed without any damaging forces being asserted to the pins.

DETAILED DESCRIPTION

The methods and apparatus described herein relate to an improved ZIF socket. The improved ZIF socket of the present invention does not have a socket cover. In embodiments of the present invention, a sliding bar is used in the ZIF socket to apply a horizontal force directly to the substrate of the integrated circuit package when the lever arm is closed. In addition, in embodiments of the present invention the socket base contains holes to guide the pins into a desired position (e.g., away from the contacts) when the pins are inserted into the socket. By integrating the pin guiding function into the base and the actuation function into the sliding bar, the present invention allows the ZIF socket cover (which previously preformed these functions) to be completely eliminated. The coverless ZIF socket of the present invention offers many advantages over prior ZIF sockets while still controlling the application of the force used to engage the pins with the contacts (i.e., maintaining the "zero insertion force" aspect of the socket).

Figure 1:
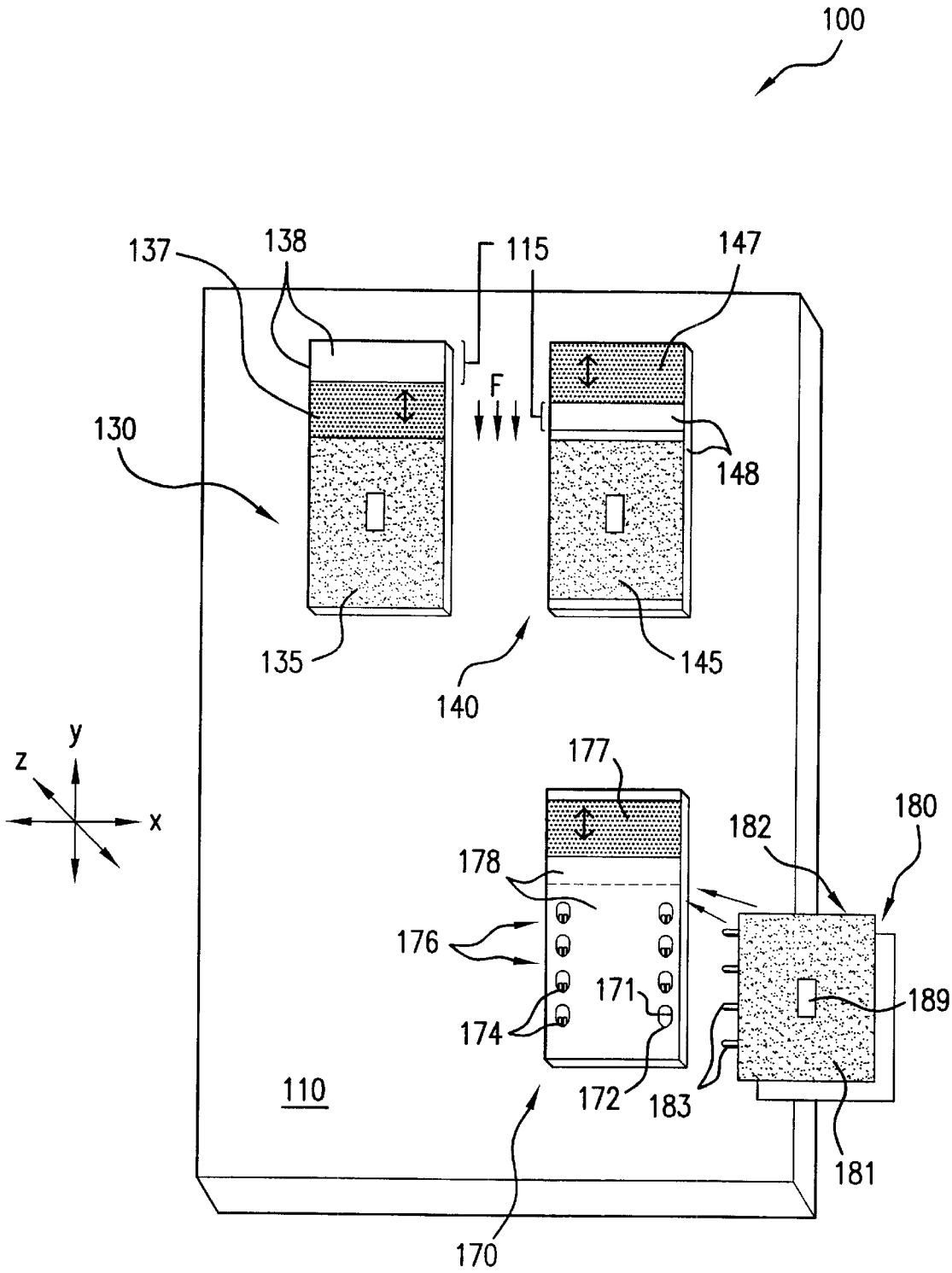
FIG. 1 is a partial block diagram of a top view of a circuit board with three coverless ZIF sockets according to an embodiment of the present invention.
Figure 3:
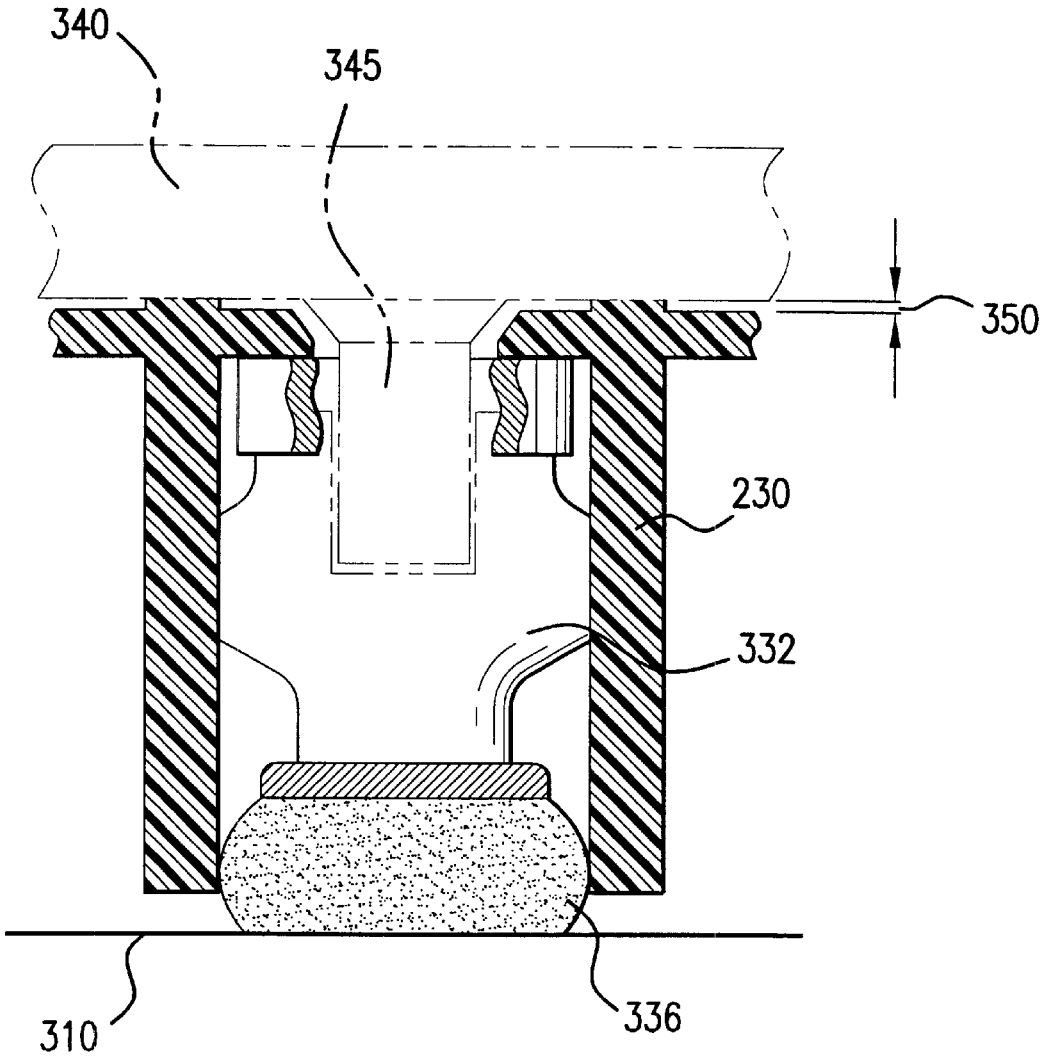
FIG. 3 is a partial block diagram of side view of a section of an integrated circuit package mounted on a coverless ZIF socket according to an embodiment of the present invention.
Figure 4:
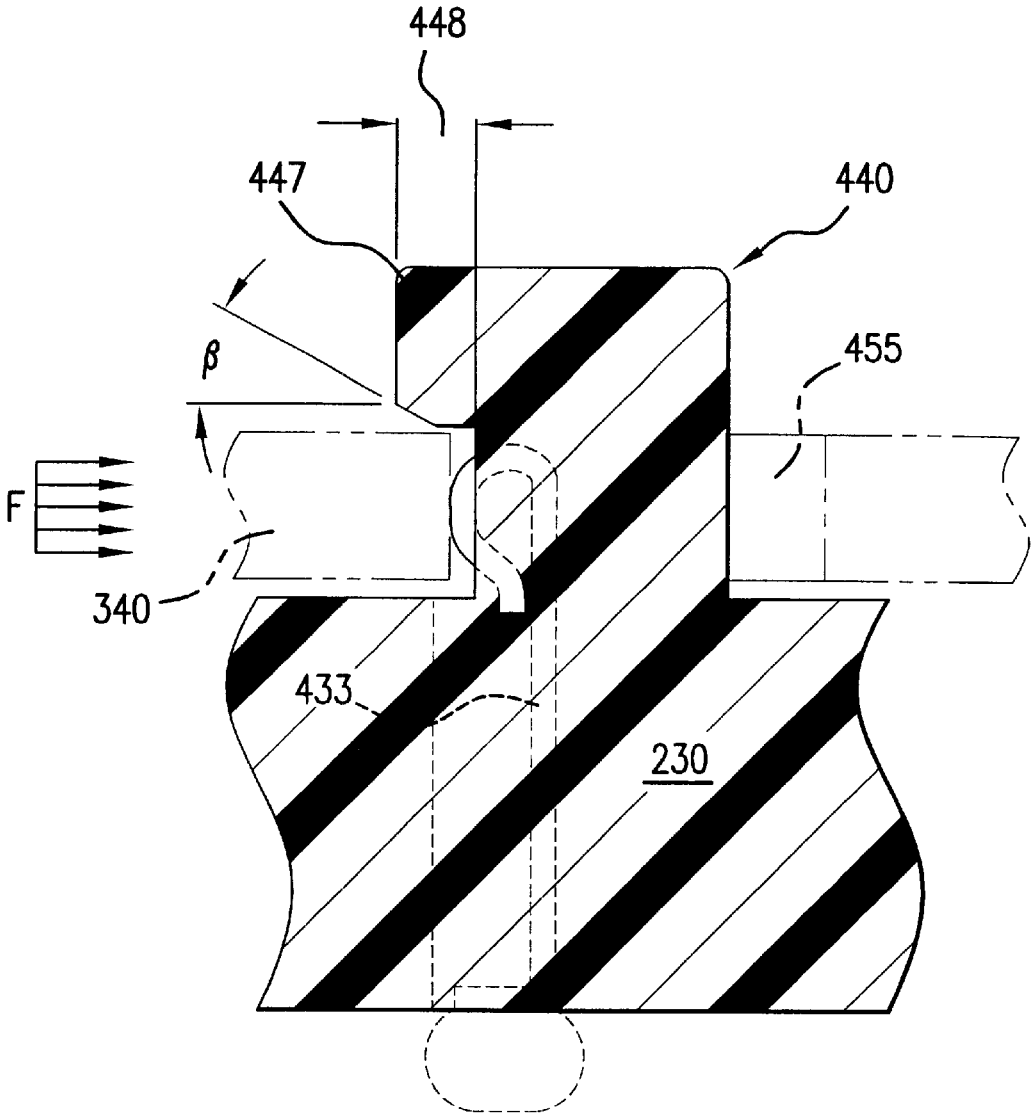
FIG. 4 is a partial block diagram of another side view of a section of an integrated circuit package mounted on a coverless ZIF socket according to an embodiment of the present invention.
Figure 5:
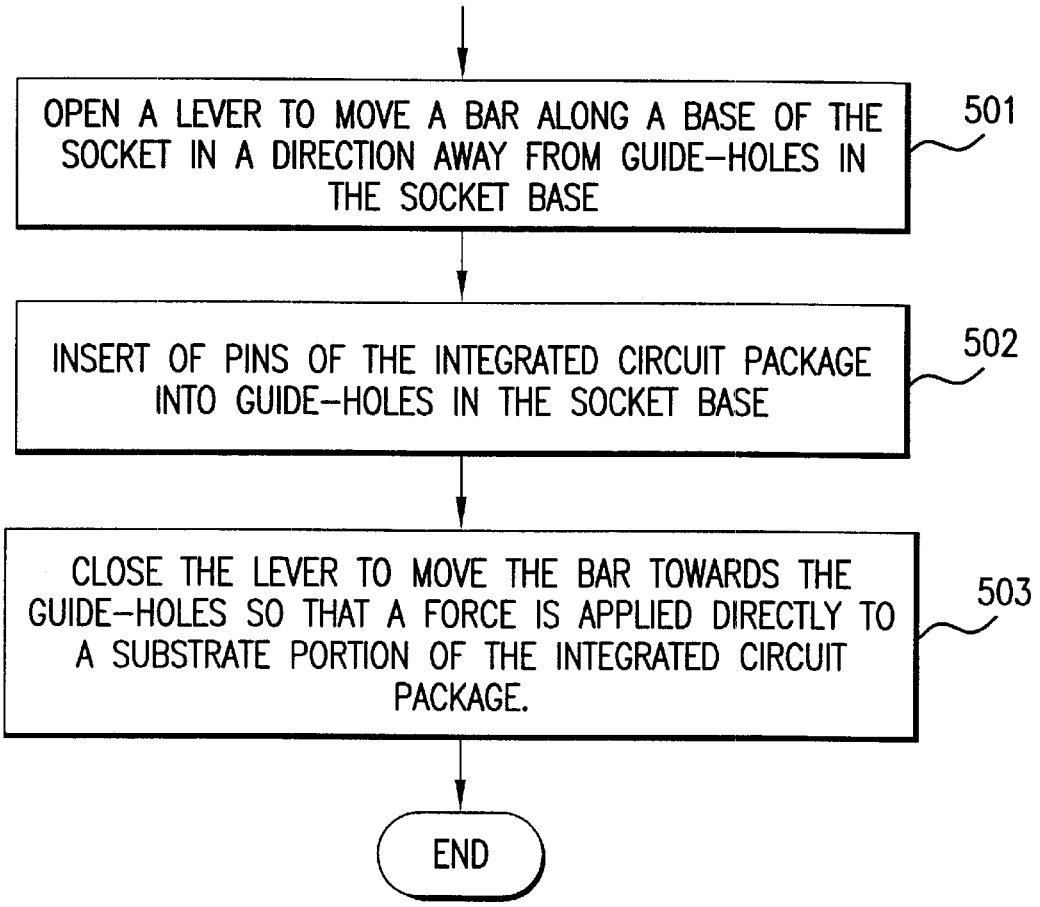
FIG. 5 is a flow chart of a method of connecting an integrated circuit package to a coverless ZIF socket according to an embodiment of the present invention.

The design and operation of a coverless ZIF socket according to embodiments of the present invention is first discussed with reference to a circuit board with coverless ZIF sockets (FIG. 1). Next, a discussion is provided of a top view of a coverless ZIF socket (FIG. 2) and two side views of a section of a coverless ZIF socket (FIGS. 3 and 4). A discussion is then provided of a method of connecting an integrated circuit package to a coverless ZIF socket according to an embodiment of the present invention (FIG. 5).

Figure 6:
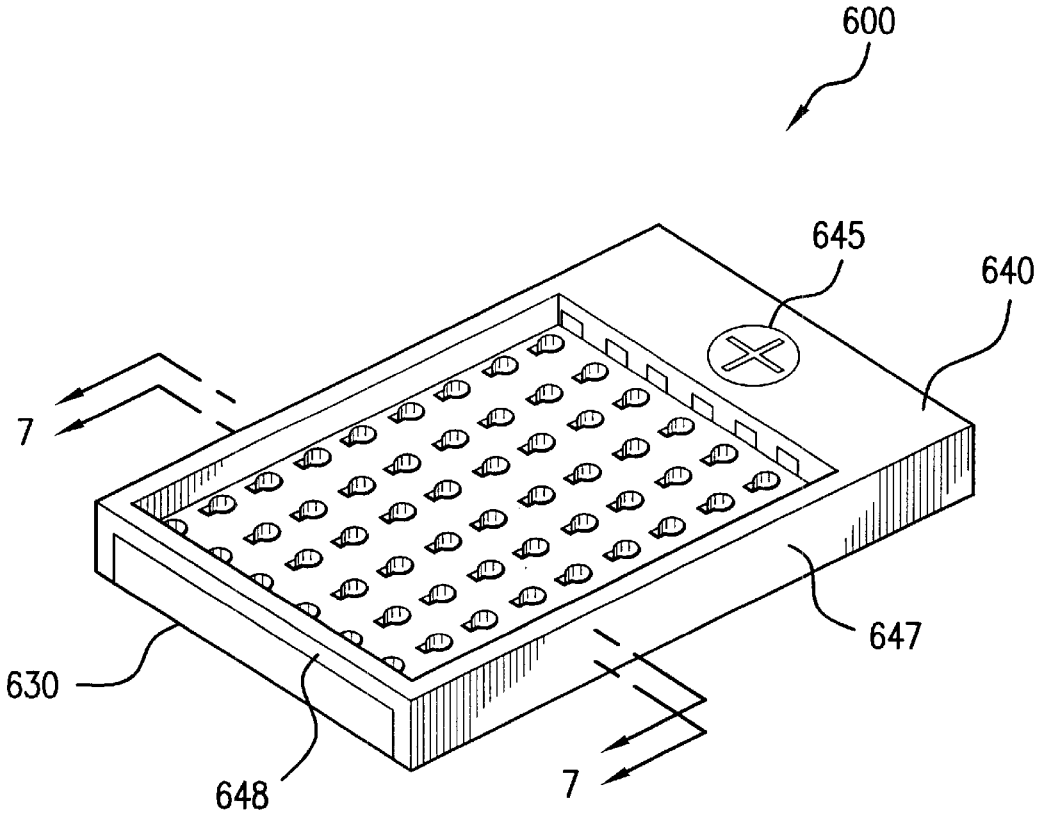
FIGS. 6 and 7 are partial block diagrams of a top view of a coverless ZIF socket, and a side view of a section of the coverless ZIF socket with an integrated circuit package, which has a sliding bar with extended side arms and a cam according to an embodiment of the present invention.
Figure 7:
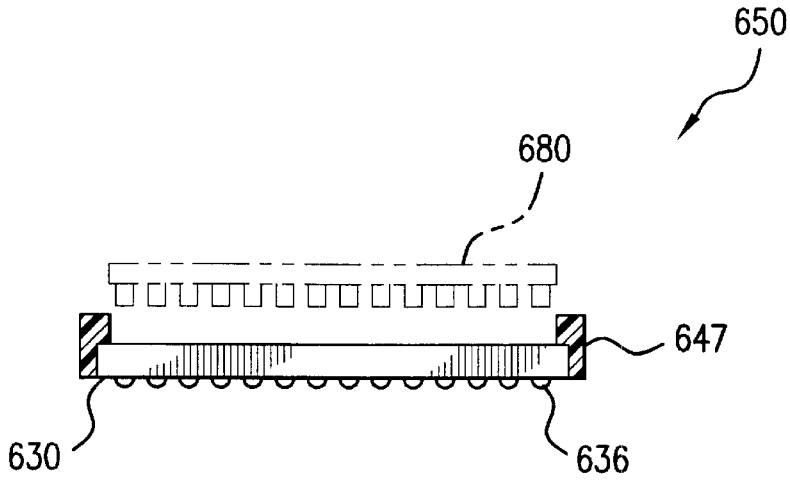

Finally, a sliding bar with extended side arms and a cam is discussed (FIGS. 6 and 7).

FIG. 1 is a partial block diagram of a top view of a circuit board with coverless ZIF sockets according to an embodiment of the present invention. FIG. 1 shows a circuit board 100 that includes a board 110 with three coverless ZIF sockets mounted on board 110. For example, circuit board 100 may be a motherboard for a personal computer, a network card, a circuit board for an appliance, etc., and board 110 be a printed circuit board. Board 110 may be a relatively thin section of epoxy with electrical connections routed within to form a circuit. As will be appreciated by a person of skill in the art, many other constructions for board 110 are also possible. The three coverless ZIF sockets mounted on board 110 are coverless ZIF socket 130, coverless ZIF socket 140, and empty coverless ZIF socket 150. In other embodiments, circuit board 100 may contain more or less sockets, some or all of which may be ZIF sockets. FIG. 1 also shows an integrated circuit package 180 that may be mounted, for example, onto empty coverless ZIF socket 150.

Coverless ZIF socket 130 and coverless ZIF socket 140 are both shown with an integrated circuit package on the socket, while empty coverless ZIF socket 150 does not contain an integrated circuit package. In particular, integrated circuit package 135 is on coverless ZIF socket 130 and integrated circuit package 145 is on coverless ZIF socket 140. As shown in FIG. 1, all three ZIF sockets have a socket base and a sliding bar that is coupled to the socket base. The term "coupled" is used herein to refer to items that are directly connected as well as indirectly connected, and the term may refer to items that are loosely connected to allow the items to move relative to one another (e.g., to slide with respect to one another). Coverless ZIF socket 130 is shown with a closed sliding bar, while coverless ZIF socket 140 is shown with an open sliding bar. In particular, coverless ZIF socket 130 contains a closed sliding bar 137 on top of socket base 138, and coverless ZIF socket 140 contains an open sliding bar 147 on top of socket base 148. The sliding bars 137 and 147 may slide back and forth in a horizontal direction with regard to plane of the socket base (i.e., in the y direction as shown in FIG. 1). Although not shown in FIG. 1, a lever arm may be used to cause the sliding bar to move back and forth. The socket base may be one piece of molded epoxy material or may have any other construction.

As is discussed above and in more detail below, the sliding bar may be used to apply an actuation force to an integrated circuit package so that the pins of the integrated circuit package engage with contacts in the socket base. That is, the sliding bar may be actuated from an open position (as shown by open sliding bar 147) to a closed position (as shown by closed sliding bar 137) and in the process may apply a horizontal force, shown as F in FIG. 1, to the substrate of an integrated circuit package so that the integrated circuit package is actuated in a horizontal direction. The force F may be, for example, 50 lbs. of force. The distance that may be traveled by the sliding bar in the direction of the horizontal, between its most open position and a closed position, is shown as actuation distance 115. Actuation distance 115 may be, for example, 1.5 mm. As shown by integrated circuit package 145, the distance from the initial position of the integrated circuit package to the desired final engaged position may be less than the actuation distance 115, and thus the sliding bar may travel further than the integrated circuit package. The present invention provides for a higher actuation distance between the substrate and the sliding bar, as compared to a covered ZIF socket, because the distance traveled by the sliding bar is limited where the sliding bar is connected to the cover.

Unlike the other two ZIF sockets shown, empty coverless ZIF socket 170 does not contain an integrated circuit package (i.e., it is empty). Empty coverless ZIF socket 170 has a socket base 178 and an open sliding bar 177 on top of socket base 178. Because empty coverless ZIF socket 170 does not currently contain an integrated circuit package, pin holes 176 are exposed. These pin holes may each be a hole in the socket base that is larger than the width of an integrated circuit package pin. Socket base 178 contains two rows of pin holes, but in other embodiments may contain a single row, a pin grid array (PGA), or any other number and/or arrangement of pin holes. The pin holes may have a non-round shape such as a tear-drop shape, pear shape, or oval shape. In an embodiment, a pin hole has a first cross-section 171 parallel to the sliding bar that is wider (in the x direction) than a second cross-section 172 of the pin hole where the second cross-section is farther from the sliding bar than the first cross-section. In the embodiment shown, the distance from a front end of each pin hole to a back end (i.e., the contact end) is less than the actuation distance of sliding of bar 177.

FIG. 1 also shows an integrated circuit package 180 that contains a substrate 181, a chip 189, and pins 183. Integrated circuit package 180 may be, for example, a central processing unit, and chip 189 may be an integrated circuit chip for a central processing unit. Of course, integrated circuit package 180 and chip 189 may also be any other type of integrated circuit package and chip. Pins 183 may be thin, conductive metal rods that protrude from the bottom of integrated circuit package 180. Pins 183 may be attached by leads to chip 189. Substrate 181 may be an epoxy material and may have a substrate edge 182.

In FIG. 1, contacts 174 may be seen through pin holes 176 in socket base 178 of empty coverless ZIF socket 170. Each of the contacts 174 may be a conductive material, such a copper or aluminum, and may formed in a curved shape to engage an integrated circuit package pin. Each contact may be adjacent to (e.g., under, in the z direction) a pin hole and may be attached to the socket base 178 and/or to the board 110. When an integrated circuit package such as integrated circuit package 180 is being inserted into socket base 178 (in the z direction), the pin holes in base 178 may guide the pins of the integrated circuit package (e.g., pins 183) so that they are in position to be engaged with the contacts 174. When sliding bar 177 is closed, it pushes directly against substrate edge 182 of integrated circuit package 180 and thus actuates the integrated circuit package (in they direction) so that the pins 183 become engaged with the contacts 174.

In an embodiment, coverless ZIF socket 130 and coverless ZIF socket 140 also contain pin holes and contacts in the socket bases such as those shown in empty coverless ZIF socket 170. The pins in integrated circuit package 135 and integrated circuit package 145 may be inserted through the pin holes in the respective socket bases. In an embodiment, the pins in integrated circuit package 135 are engaged with contacts in socket base 138 because the sliding bar 137 is closed, while the pins in integrated circuit package 145 may not yet be engaged with the contacts in socket base 148.

Figure 2:
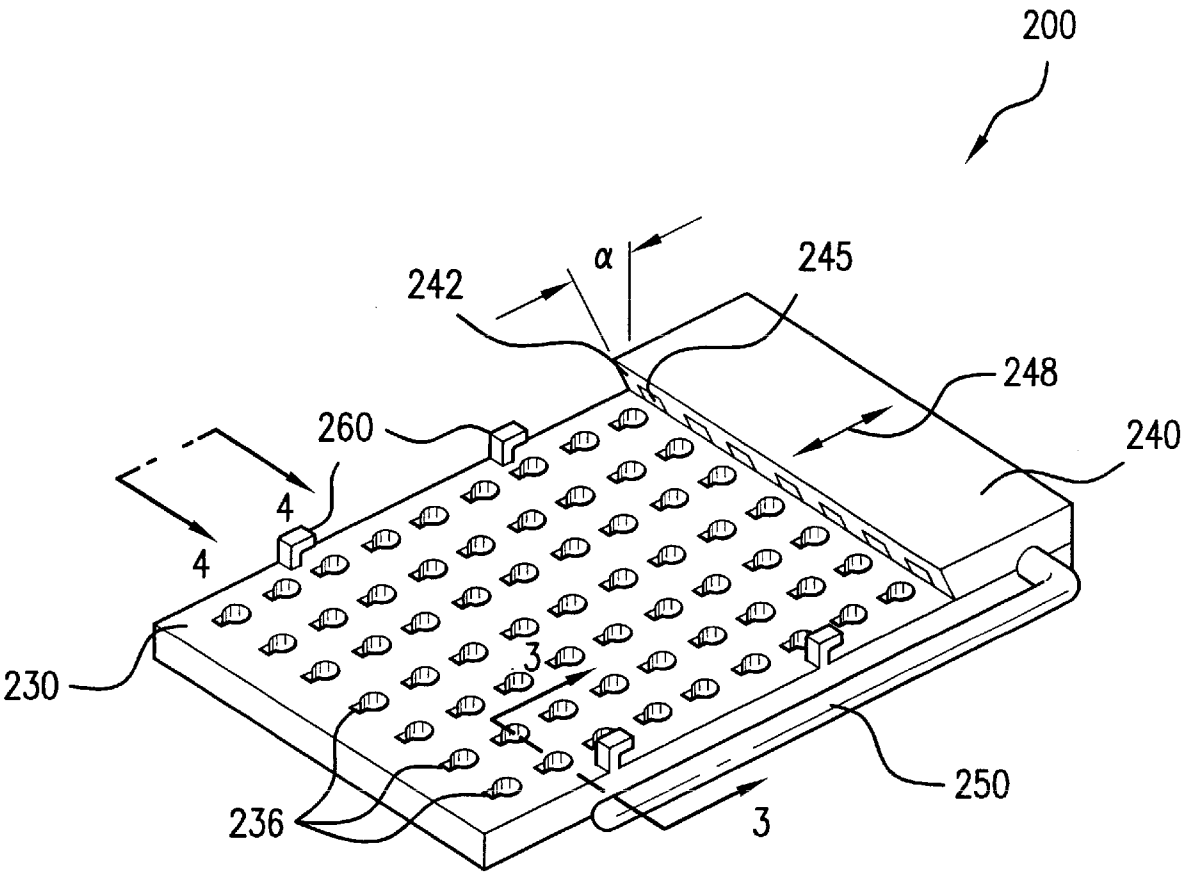
FIG. 2 is a partial block diagram of a top view of a coverless ZIF socket according to an embodiment of the present invention.

FIG. 2 is a partial block diagram of a top view of a coverless ZIF socket according to an embodiment of the present invention. FIG. 2 shows a coverless ZIF socket 200 viewed from the top at an angle so that two of the sides of the socket are also visible. Coverless ZIF socket 200 has a socket base 230, a sliding bar 240 coupled to the socket base, and an actuation lever arm 250 coupled to the sliding bar. In an embodiment, sliding bar 240 slides along socket base 230 along a horizontal plane in actuation direction 248 whenever actuation lever arm 250 is raised or lowered. Thus, the closing (i.e., lowering) of actuation lever arm 250 may cause sliding bar 240 to push against the substrate of an integrated circuit package (not shown) that may be positioned on socket base 230. In an embodiment, another mechanism for moving sliding bar 240 may be used instead of actuation lever arm 250, such as a cam, a sliding wedge, a rocker arm, or a screw type actuator. An embodiment of such a cam is shown in FIG. 6 and discussed below with reference to that figure.

In an embodiment, the bottom of the lever arm 250 pivots when the top of lever arm 250 is moved. In an embodiment, sliding bar 240 and actuation lever arm 250 may be coupled to a cam that allows the sliding bar to slide back and forth when actuation lever arm 250 is raised or lowered. Sliding bar 240 may be plastic or other material and may be generally in the shape of a three-dimensional rectangle or wedge. As shown in FIG. 2, sliding bar 240 has a front face 242 on the side of sliding bar 240 that is closest to (i.e., facing) the pin holes of socket base 230. When an integrated circuit package is positioned in socket base 230 and actuation lever arm 250 is closed, front face 242 may abut and apply a force directly to the substrate edge of the integrated circuit package. By pushing against the substrate edge, front face 242 of sliding bar 240 may actuate the integrated circuit package so that the pins of the integrated circuit package engage contacts in the socket base.

In an embodiment, at least a part of front face 242 is slanted at a non-perpendicular angle with respect to the horizontal plane of socket base 230. Due to this slant angle feature, the sliding bar may apply a vertical force to an integrated circuit package, in addition to the horizontal force discussed above, so that the integrated circuit package maintains contact with the socket base 230 during and/or after actuation of the integrated circuit package. In this embodiment, part or all of front face 242 may overhang socket base 230 at an angle $\alpha$ with respect to a line that is perpendicular to the horizontal plane of the socket base 230. In an embodiment, the angle $\alpha$ is equal to 30 degrees to 45 degrees, but this angle may also be greater or smaller in other embodiments. In an embodiment, front face 242 is generally straight, but in other embodiments front face 242 may be curved or may have a number of straight planes.

In an embodiment, a number of power connectors 245 are attached to front face 242. In an embodiment, power connectors 245 may contact with power connectors in the substrate edge of an integrated circuit package, such as substrate edge 182 of FIG. 1, to provide additional power to the integrated circuit package. In an embodiment, 15–20 power connectors are attached to front face 242, but more or less power connectors may also be used. In an embodiment, power connectors 245 are high power connectors. For example, power connectors 245 may collectively provide an additional 50 amps of current to an integrated circuit package. In an embodiment, power connectors 245 are leaf springs and are cantilevered, but in other embodiments other types of power connectors may be used such as a slot, brush, or compression type connector. Reliable power connectors may be added to coverless ZIF socket 200 because elimination of the cover allows the sliding bar to travel a relatively large actuation distance and thus a relatively significant force, and a good electrical contact, may be provided between the sliding bar and the integrated circuit package. In addition, the high actuation distance allows the leaf springs to be safely retracted away from the substrate so that a chip may be removed from the socket without damage caused by a protruding leaf spring. By contrast, a covered ZIF socket may not provide enough tolerance to include a power connector.

Socket base 230 contains a number of pin holes 236 which may be the same as the pin holes 176 discussed above. Socket section view A—A 300 shows a part of socket base 230, including a pin hole, and is discussed below in more detail with reference to FIG. 3. In addition, four alignment posts 260 extend generally upward from socket base 230. In other embodiments, the socket base has more or fewer alignment posts. Socket section view B shows another part of socket base 230, including an alignment post, and is discussed below in more detail with reference to FIG. 4.

FIG. 3 is a partial block diagram of side view of a section of an integrated circuit package mounted on a coverless ZIF socket according to an embodiment of the present invention. FIG. 3 shows socket section view A—A 300 of FIG. 2 and includes a part of socket base 230, a part of a circuit board 310, and a part of an integrated circuit package substrate 340. Socket base 230 includes a contact 332 that is coupled to socket base 230 and to circuit board 310 by a solder ball 336. A pin 345 is attached to integrated circuit package substrate 340. In the embodiment shown, the integrated circuit package substrate 340 and the pin 345 move toward the viewer when the substrate is as actuated by the sliding bar. In an embodiment, pin 345 is shown engaged in contact 332 to form an electrical connection. FIG. 3 shows an air gap 350 between integrated circuit package substrate 340 and socket base 230. That is, the top of socket base 230 may contain a channel or tunnel that allows air to flow, and this channel may be continued to the edge of the socket. Because the socket does not have a cover that may prevent the passage of air outside the socket, air gap 350 may allow for the circulation of air between the pin/contact and the outside edges of the socket, thus increasing natural and/or forced convection cooling within the socket.

FIG. 4 is a partial block diagram of another side view of a section of an integrated circuit package mounted on a coverless ZIF socket according to an embodiment of the present invention. FIG. 4 shows socket section view B 400 of FIG. 2 and includes a part of socket base 230 and a part of an integrated circuit package substrate 340. FIG. 4 also shows an alignment post 440 that extends upward from socket base 230 and a power connector 433 that is partially located within alignment post 440. Alignment post 440 may be the same material as socket base 230 or may be a different material. As discussed above with reference to power connectors 245, power connector 433 may a leaf spring or other type of connector and may be a high power connector.

As shown in FIG. 4, when force F is applied against the integrated circuit package substrate 340, the integrated circuit package substrate 340 is actuated by an actuation distance 448. Integrated circuit package substrate 340 contains a notch 455 that allows the integrated circuit package substrate 340 to fall over alignment post 440 and allows for the actuation of integrated circuit package substrate 340 around alignment post 440. In an embodiment, after the integrated circuit package substrate 340 is actuated so that the pins engage the contacts in the socket base 230, integrated circuit package substrate 340 will come in contact with a face of alignment post 440. When the integrated circuit package substrate has been actuated as described, a power connector (not shown) in integrated circuit package substrate 340 may contact with power connector 433 so that additional power may be provided to the integrated circuit package. In an embodiment, alignment post 440 contains an overhanging projection, such as shoulder 447, that extends above part of integrated circuit package substrate 340 during and after actuation. In this regard, shoulder 447 may clamp down upon the integrated circuit package substrate 340 so that the substrate does not spring up (i.e., away from the socket base) during and after lever actuation. In an embodiment, a part of the shoulder 447 projects outward from alignment post 440 and is slanted at an angle β with respect to the horizontal axis of the socket base 230. In an embodiment, the angle β is equal to 30 degrees, but the angle β may be greater or smaller in other embodiments. Such a slant in a corner of shoulder 447 may cause the integrated circuit package to be forced under shoulder 447 when force F is applied. In an embodiment, the slanted corner of shoulder 447 may be partially or entirely rounded or may contain a series of planes. The alignment post 440 may prevent movement of the chip in the z and/or x directions as these directions are shown in FIG. 1. In embodiments, the socket base 230 may have one or more alignment posts that have a power connector and/or a clamping down shoulder.

FIG. 5 is a flow chart of a method of connecting an integrated circuit package to a coverless ZIF socket according to an embodiment of the present invention. The method shown in FIG. 5 may be practiced with reference to the embodiments of the coverless ZIF socket discussed above as well as with other embodiments of the coverless ZIF socket. According to the method shown, a lever is opened to move a bar along a base of the socket in a direction away from guide-holes in the socket base. If the socket currently contains an integrated circuit package, then that integrated circuit package may be removed at this time (501) using, for example, a notch in end of the substrate or the extended arms of the sliding bar shown in FIG. 6. For example, the integrated circuit package has a notch in the end of the substrate that is furthest from the sliding bar, and a person may apply a horizontal force to the integrated circuit package in a direction away from the connectors in the base by inserting part of the person's finger, or another object, into the notch. In another embodiment, the integrated circuit package does not have a notch and a person may disengage the pins of the integrated circuit package from the contacts by applying a force to the end of the substrate with a screw driver or other object.

Next, the pins of the integrated circuit package may be inserted into the guide-holes in the socket base (502). The guide-holes may guide the pins away from the contacts so that the pins are not damaged at this time. Thus, there is little or no insertion force exerted on the pins when the chip is inserted onto the integrated circuit package. When the pins are thus inserted, the integrated circuit package substrate comes into contact with the socket base. Next, the lever may be closed to move the bar towards the guide-holes so that a force is applied directly to a substrate portion of the integrated circuit package (503). When the substrate is thus actuated, it causes the pins to engage with the contacts in the socket base. According to this method, the lever, sliding bar, and guide-holes control the application of the force used to engage the pins with the contacts.

FIG. 6 shows a partial block diagram of a top view of a coverless ZIF socket, and a side view of a section of the coverless ZIF socket with an integrated circuit package, which has a sliding bar with extended side arms and a cam according to an embodiment of the present invention. Coverless ZIF socket 600 is first shown in a top view from an angle. Coverless ZIF socket 600 includes a socket base 630 and a sliding bar 640 which has extended side arms. The socket base 630 may include a plurality of pin holes as discussed above. In the embodiment shown, sliding bar 640 includes a cam 645 that may be used to cause sliding bar 640 to slide in the horizontal direction. In this embodiment, cam 645 may take the place of actuation lever arm 250 of FIG. 2. For example, when cam 645 is rotated in the clockwise direction, it may cause sliding bar 640 to move into a closed position. Cam 645 may have a slot to receive a screw-driver head. Sliding bar 640 includes side arm 647 and rear arm 648.

FIG. 7 also shows side view of coverless ZIF socket 600, as a socket section 7—7 650, that includes a cross section view of socket base 630 and side arm 647. Socket section 7—7 650 shows a cross section of coverless ZIF socket 600 along the axis 7—7. FIG. 7 also shows a cross-sectional view of an integrated circuit package 680 that may be mounted in coverless ZIF socket 600. In an embodiment, integrated circuit package 680 fits between the side arms, front face, and rear face of sliding bar 640. Solder balls, such as solder ball 636, may extend from the bottom of socket base 630.

Because the side arms and rear arm are part of sliding bar 640, the side arms and rear arms will move with the sliding bar 640 when it is actuated in a horizontal direction. In an embodiment, when the sliding bar 640 is "opened," the rear arm 648 will apply an horizontal force to the back end of the substrate of any integrated circuit package that is mounted in coverless ZIF socket 600. Thus, in this embodiment the rear arm of the sliding bar operates in the same manner, but in the opposite direction, as the front face 242 of the sliding bar 240 of FIG. 2.

The present invention provides a coverless ZIF socket. In an embodiment of the present invention, a sliding bar is used to apply a horizontal force directly to the substrate of an integrated circuit package, and the socket base contains holes to guide the pins into position when the pins are inserted into the socket. Several embodiments of the present invention are specifically illustrated and/or described herein. However, it will be appreciated that modifications and variations of the present invention are covered by the above teachings and within the purview of the appended claims without departing from the spirit and intended scope of the invention.

I claim:

1. A socket comprising:

an uncovered base, wherein an alignment post extends generally upward from the base, and wherein the alignment post contains a power connector;

a plurality of conductive pin contacts coupled to the base; and a slidable bar coupled to the base to directly apply an actuation force to a substrate of an integrated circuit package, wherein the slidable bar has a front face, and wherein a power connector is attached to the front face of the slidable bar.

2. The socket of claim 1, wherein the base has a plurality of pin holes, and wherein each of the conductive contacts is positioned adjacent to a pin hole.

3. The socket of claim 2, wherein one of the pin holes has a first cross-section and a second cross-section that is further from the slidable bar than the first cross-section, and wherein the first cross-section is wider than the second cross-section.

4. The socket of claim 1, wherein at least a part of the front face of the slidable bar is slanted at a non-perpendicular angle with respect to the base.

5. A The socket of claim 1, wherein the power connector is a leaf spring.

6. The socket of claim 1 wherein the alignment post includes an overhanging projection.

7. A socket for an integrated circuit package, the socket comprising:

a base to directly contact to a substrate of the integrated circuit package, wherein the base has a plurality of guide holes to receive pins of the integrated circuit package; and a bar coupled to the base to directly apply an actuation force to the substrate, wherein the bar has a front face, and wherein a plurality of power connectors are attached to the front face of the bar.

8. The socket of claim 7, wherein the socket has a lever arm coupled to the bar.

9. The socket of claim 7, wherein at least a part of the front face of bar overhangs the socket base to maintain the integrated circuit package in contact with the socket base during and after the application of the actuation force.

10. The socket of claim 9, wherein the base contains a gap to allow air to pass between at least one of the guide holes and an outside edge of the socket when an integrated circuit package is mounted on the socket.

11. The socket of claim 10, wherein an alignment post extends generally upward from the base, and wherein the alignment post contains a power connector.

12. A socket for an integrated circuit package, the socket comprising:

a base, wherein the base has holes to guide the integrated circuit package pins, wherein an alignment post extends generally upward from the base, and wherein the alignment post contains a power connector;

a plurality of contacts coupled to the base; and a means for directly applying an actuation force to a substrate of the integrated circuit package so that pins of the integrated circuit package engage the contacts.

13. The socket of claim 12, wherein the socket further comprises a means for applying power to an edge of the integrated circuit package substrate.

14. The socket of claim 13, wherein the socket further comprises a means for maintaining the integrated circuit package in contact with the base after the application of the actuation force.

15. A method of connecting an integrated circuit package to a socket, the method comprising:

moving a bar along a base of the socket in a direction away from guide-holes in the socket base;

inserting a plurality of pins of the integrated circuit package into the guide-holes in the socket base; and moving the bar towards the guide-holes so that a force is applied directly by the bar to a substrate portion of the integrated circuit package, wherein moving the bar into contact with the integrated circuit package causes a power connector in the bar to contact with a power connector in the integrated circuit package.

16. The method of claim 15, wherein the base has an alignment post, and wherein moving the bar into contact with the substrate causes a power connector in the alignment post to contact with a power connector in the integrated circuit package.

17. A circuit board comprising:

a board;

a coverless zero insertion force socket which has a base and an alignment post that extends generally upward from the base, wherein the alignment post includes an overhanging projection, wherein the coverless zero insertion force socket has a base, wherein the base has a plurality of pin holes, wherein the pin holes in the base are not round, wherein the coverless zero insertion force socket has a slidable bar, wherein a front face of the slidable bar is at least in part slanted at a non-perpendicular angle with respect to the base, and wherein a plurality of power connectors are attached to the front face of the slidable bar; and an integrated circuit package mounted to the coverless zero insertion force socket.

18. An apparatus comprising a zero insertion force socket, the socket comprising a base, a plurality of contacts coupled to the base, and a bar coupled to the base, wherein said socket does not have a cover, wherein the bar has a front face at least a part of which is slanted at a non-perpendicular angle with respect to the base, wherein a front face of the slidable bar is at least in part slanted at a non-perpendicular angle with respect to the base, and wherein a plurality of power connectors are attached to the front face of the slidable bar.

19. The apparatus of claim 18, wherein the base has a plurality of pin holes.

20. A socket comprising:

an uncovered base, wherein the base has a plurality of pin holes, wherein one of the pin holes has a first cross-section and a second cross-section that is further from the slidable bar than the first cross-section, and wherein the first cross-section is wider than the second cross-section, wherein an alignment post extends generally upward from the base, and wherein the alignment post contains a power connector;

a plurality of conductive pin contacts coupled to the base, wherein each of the conductive contacts is positioned adjacent to a pin hole; and a slidable bar coupled to the base to directly apply an actuation force to a substrate of an integrated circuit package.

21. The socket of claim 20, wherein the slidable bar has a front face at least a part of which is slanted at a non-perpendicular angle with respect to the base.

22. The socket of claim 21, wherein a power connector is attached to the front face of the slidable bar, and wherein the power connector is a leaf spring.

23. The socket of claim 20, wherein an alignment post extends generally upward from the base, and wherein the alignment post includes an overhanging projection.

24. A socket comprising:

an uncovered base, wherein an alignment post extends generally upward from the base, and wherein the alignment post includes an overhanging projection;

a plurality of conductive pin contacts coupled to the base; and a slidable bar coupled to the base to directly apply an actuation force to a substrate of an integrated circuit package, wherein the slidable bar has a front face, and wherein a power connector is attached to the front face of the slidable bar.

25. The socket of claim 24, wherein the base has a plurality of pin holes, and wherein each of the conductive contacts is positioned adjacent to a pin hole.

26. The socket of claim 25, wherein one of the pin holes has a first cross-section and a second cross-section that is further from the slidable bar than the first cross-section, and wherein the first cross-section is wider than the second cross-section.

27. The socket of claim 24, wherein at least a part of the front face of the slidable bar is slanted at a non-perpendicular angle with respect to the base.

28. The socket of claim 24, wherein the power connector is a leaf spring.

29. The socket of claim 24, wherein the alignment post contains a power connector.

30. A socket comprising:

an uncovered base;

a plurality of conductive pin contacts coupled to the base; and a slidable bar coupled to the base to directly apply an actuation force to a substrate of an integrated circuit package, wherein the slidable bar has a front face, wherein a power connector is attached to the front face of the slidable bar, and wherein the power connector is a leaf spring.

31. The socket of claim 30, wherein the base has a plurality of pin holes, and wherein each of the conductive contacts is positioned adjacent to a pin hole.

32. The socket of claim 31, wherein one of the pin holes has a first cross-section and a second cross-section that is further from the slidable bar than the first cross-section, and wherein the first cross-section is wider than the second cross-section.

33. The socket of claim 30, wherein at least a part of the front face of the slidable bar is slanted at a non-perpendicular angle with respect to the base.

34. The socket of claim 30, wherein an alignment post extends generally upward from the base, and wherein the alignment post includes an overhanging projection.

35. The socket of claim 30, wherein an alignment post extends generally upward from the base, and wherein the alignment post contains a power connector.

36. A socket comprising:

an uncovered base;

a plurality of conductive pin contacts coupled to the base; and a slidable bar coupled to the base to directly apply an actuation force to a substrate of an integrated circuit package, wherein the slidable bar has a front face, and wherein a power connector is attached to the front face of the slidable bar, wherein at least a part of the front face of the slidable bar is slanted at a non-perpendicular angle with respect to the base.

37. The socket of claim 36, wherein the base has a plurality of pin holes, and wherein each of the conductive contacts is positioned adjacent to a pin hole.

38. The socket of claim 37, wherein one of the pin holes has a first cross-section and a second cross-section that is further from the slidable bar than the first cross-section, and wherein the first cross-section is wider than the second cross-section.

39. The socket of claim 36, wherein the power connector is a leaf spring.

40. The socket of claim 36, wherein an alignment post extends generally upward from the base, and wherein the alignment post includes an overhanging projection.

41. The socket of claim 36, wherein an alignment post extends generally upward from the base, and wherein the alignment post contains a power connector.

42. A socket comprising:

an uncovered base;

a plurality of conductive pin contacts coupled to the base; and a slidable bar coupled to the base to directly apply an actuation force to a substrate of an integrated circuit package, wherein the slidable bar has a front face, and wherein a power connector is attached to the front face of the slidable bar, wherein the base has a plurality of pin holes, wherein each of the conductive contacts is positioned adjacent to a pin hole, wherein one of the pin holes has a first cross-section and a second cross-section that is further from the slidable bar than the first cross-section, and wherein the first cross-section is wider than the second cross-section.

43. The socket of claim 42, wherein at least a part of the front face of the slidable bar is slanted at a non-perpendicular angle with respect to the base.

44. The socket of claim 42, wherein the power connector is a leaf spring.

45. The socket of claim 42, wherein an alignment post extends generally upward from the base, and wherein the alignment post includes an overhanging projection.

46. The socket of claim 42, wherein an alignment post extends generally upward from the base, and wherein the alignment post contains a power connector.

47. A socket comprising:

an uncovered base, wherein the base has a plurality of pin holes, wherein one of the pin holes has a first cross-section and a second cross-section that is further from the slidable bar than the first cross-section, and wherein the first cross-section is wider than the second cross-section;

a plurality of conductive pin contacts coupled to the base, wherein each of the conductive contacts is positioned adjacent to a pin hole; and a slidable bar coupled to the base to directly apply an actuation force to a substrate of an integrated circuit package, wherein the slidable bar has a front face at least a part of which is slanted at a non-perpendicular angle with respect to the base, wherein a power connector is attached to the front face of the slidable bar, and wherein the power connector is a leaf spring.

48. The socket of claim 47, wherein an alignment post extends generally upward from the base, and wherein the alignment post includes an overhanging projection.

49. The socket of claim 47, wherein an alignment post extends generally upward from the base, and wherein the alignment post contains a power connector.

* * * * *